US009799971B2

(12) United States Patent
Ninomiya et al.

(10) Patent No.: US 9,799,971 B2
(45) Date of Patent: Oct. 24, 2017

(54) FLOATING CONNECTOR WITH MULTIPLE FITTING-SIDE HOUSINGS

(71) Applicants: Toyota Jidosha Kabushiki Kaisha, Aichi-ken (JP); Iriso Electronics Co., Ltd., Yokohama, Kanagawa (JP)

(72) Inventors: Kayoko Ninomiya, Miyoshi (JP); Nobutoshi Hagiwara, Miyoshi (JP); Yuki Ide, Miyoshi (JP); Hitoshi Suzuki, Kanagawa (JP); Hiroaki Kobayashi, Kanagawa (JP); Yoshiyuki Ogura, Kanagawa (JP)

(73) Assignees: TOYOTA JIDOSHA KABUSHIKI KAISHA, Aichi-ken (JP); IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 15/267,283

(22) Filed: Sep. 16, 2016

(65) Prior Publication Data

US 2017/0264032 A1 Sep. 14, 2017

(30) Foreign Application Priority Data

Mar. 8, 2016 (JP) ..... 2016-044949

(51) Int. Cl.
*H01R 12/52* (2011.01)
*H01R 13/631* (2006.01)
(Continued)

(52) U.S. Cl.
CPC ..... *H01R 12/52* (2013.01); *H01R 13/14* (2013.01); *H01R 13/6315* (2013.01);
(Continued)

(58) Field of Classification Search
CPC ..... H01R 12/52; H01R 12/716; H01R 9/096; H01R 13/6315; H01R 12/91; H01R 13/64
(Continued)

(56) References Cited

U.S. PATENT DOCUMENTS

2006/0089018 A1* 4/2006 Orita ..... H01R 12/57 439/74
2007/0202729 A1* 8/2007 Uesaka ..... H01R 12/57 439/248
(Continued)

FOREIGN PATENT DOCUMENTS

JP 5-23465 U 3/1993
JP 2006-120448 A 5/2006
(Continued)

OTHER PUBLICATIONS

Office Action from Japanese Patent App. No. 2016-044949 dated Jul. 25, 2017.

*Primary Examiner* — Abdullah Riyami
*Assistant Examiner* — Justin Kratt
(74) *Attorney, Agent, or Firm* — Cermak Nakajima & McGowan LLP; Tomoko Nakajima

(57) ABSTRACT

A plug connector includes a substrate-side housing, a fitting-side housing, a plurality of terminals having movable springs. The fitting-side housing is formed by a plurality of divided housings. The fitting-side housing is formed by a plurality of divided housings moveable separately in a width direction of the connector. The substrate-side housing includes a receiving chamber that receives the divided housings therein and an abutment receiving portion against which the divided housings displaced inside the receiving chamber abut. The terminals are disposed in each of the divided housings, and have contact portions inside the substrate-side housing and the divided housings, and the contact portions are to be in conductive contact with the
(Continued)

connection object. The movable springs support each of the divided housings displaceably relative to the substrate-side housing.

9 Claims, 13 Drawing Sheets

(51) Int. Cl.

| | |
|---|---|
| ***H01R 13/14*** | (2006.01) |
| *H01R 12/71* | (2011.01) |
| *H01R 12/00* | (2006.01) |
| *H01R 12/91* | (2011.01) |
| *H01R 13/64* | (2006.01) |

(52) U.S. Cl.
CPC ..... *H01R 9/096* (2013.01); *H01R 12/716* (2013.01); *H01R 12/91* (2013.01); *H01R 13/64* (2013.01)

(58) Field of Classification Search
USPC ..... 439/74, 246, 247, 680
See application file for complete search history.

(56) References Cited

U.S. PATENT DOCUMENTS

2008/0214035 A1* 9/2008 Uesaka ..... H01R 12/57 439/247
2011/0294326 A1* 12/2011 Tanaka ..... H01R 12/712 439/248
2014/0342614 A1 11/2014 Yukutake et al.

FOREIGN PATENT DOCUMENTS

JP 2011-249076 A 12/2011
JP 2014-229407 A 12/2014

* cited by examiner

Fig.3
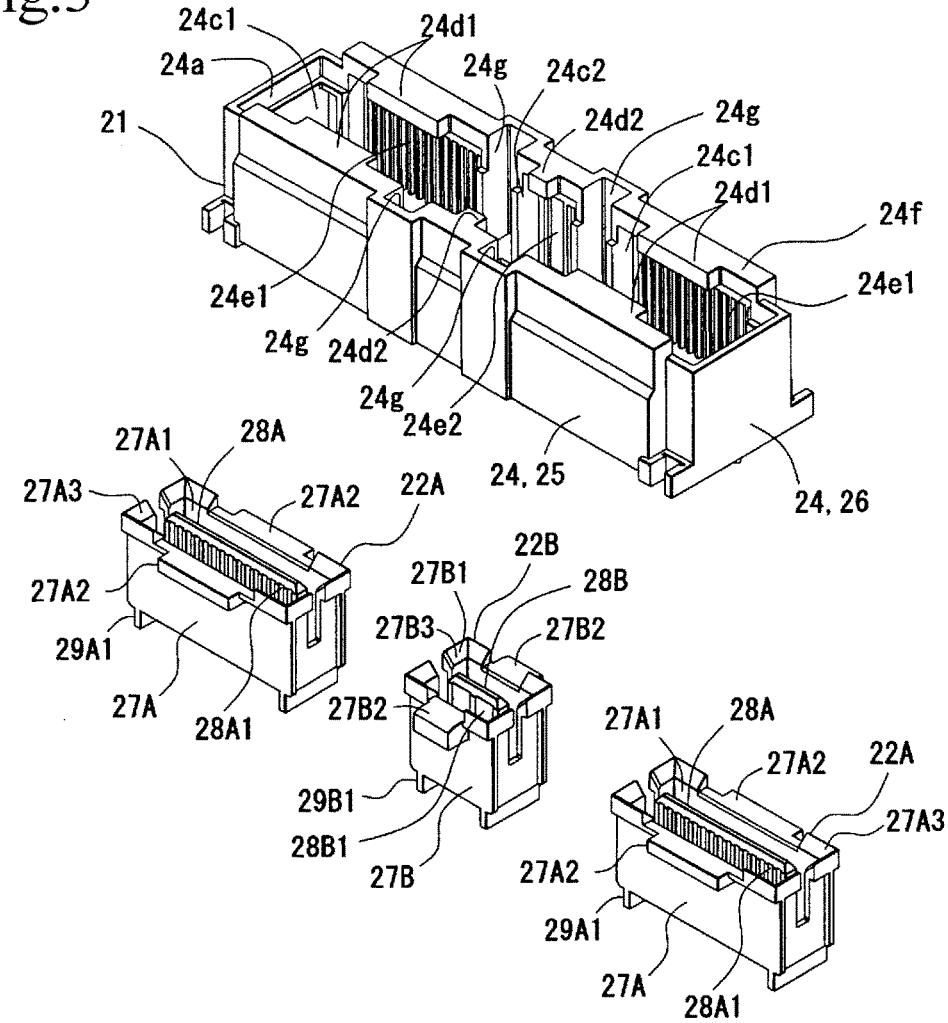
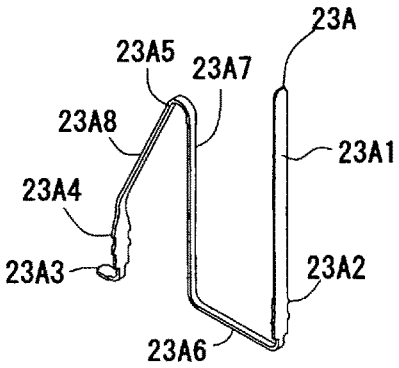
Fig.4A
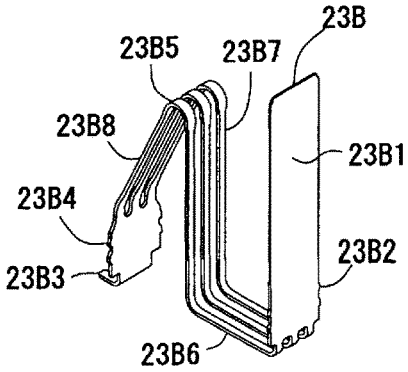
Fig.4B

FLOATING CONNECTOR WITH MULTIPLE FITTING-SIDE HOUSINGS

BACKGROUND OF THE INVENTION

1. Field of the Invention

The present invention relates to a connector, and more particularly, to a floating connector.

2. Description of the Related Art

A floating connector is known as a connector that electrically connects substrates. The floating connector includes a substrate-side housing to be mounted on a substrate, a fitting-side housing received in the substrate-side housing, and terminals fixed at one end to the substrate-side housing, fixed at the other end to the fitting-side housing, and having movable springs that elastically support the fitting-side housing displaceably relative to the substrate-side housing. This floating connector is mounted on one of the substrates to be connected to each other. On the other substrate, a counterpart connector is mounted as a connection object to be fitted and connected to the fitting-side housing of the floating connector (see, for example, Japanese Unexamined Patent Application Publication No. 2011-249076).

For example, one or an accumulation of a tolerance of a housing of an electronic apparatus, a tolerance of a seat at which a substrate is screwed to the housing, and a warp occurring in the substrate becomes a disturbance factor that hinders connectors connected to each other from being inserted and fitted in a proper posture. Such a disturbance factor appears as a relative tilt between substrates on which the connectors are mounted when the connectors are inserted and fitted.

FIG. 13 is a schematic view of an example of such a floating connector, and illustrates a state in which a substrate P1 on which a floating connector 1 is mounted is turned on a front-rear direction Y orthogonal to a width direction X and is tilted relative to a substrate P2 on which a counterpart connector M is mounted. The floating connector 1 requires reliable fitting and connection to the counterpart connector M while assuming that there is such a tilt between the substrates P1 and P2.

For this reason, the floating connector 1 has a floating function such that a fitting-side housing 3 is displaced relative to a substrate-side housing 2 to absorb the tilt of the substrate P1. The fitting-side housing 3 is displaced by elastic deformation of movable springs 4 and 5 of terminals. Therefore, when the substrate P1 is tilted in the fitted state, as illustrated in FIG. 13, the right movable spring 5 in FIG. 13 is greatly expanded upward in the initial state of fitting, and a great stress constantly acts. Hence, in the existing floating connector 1, problems, such as plastic deformation of the movable springs 4 and 5 and deterioration of fatigue durability, sometimes occur.

Further, in the conventional floating connector 1, fall-preventing projections 3*a* for the substrate-side housing 2 project from both sides of the fitting-side housing 3 in the width direction X, and the substrate-side housing 2 has abutment receiving portions 2*a* by which the fall-preventing projections 3*a* are retained. Between the fall-preventing projections 3*a* and the abutment receiving portions 2*a*, movable gaps 6 of the fitting-side housing 3 are provided. For this reason, the conventional floating connector 1 has a problem in that the fitting-side housing 3 and the substrate-side housing 2 are large in the width direction X.

SUMMARY OF THE INVENTION

An object of the present invention made in the context of the above related art is to reduce the load acting on movable springs of terminals in a fitted state in a connector for connecting substrates even when the substrates are tilted relative to each other before fitting to a counterpart connector. Another object of the present invention is to reduce the size of the connector in a width direction.

To achieve the above objects, the present invention has the following features.

A connector according to a first aspect of the present invention includes a housing having a substrate-side housing to be mounted on a substrate and a fitting-side housing to be fitted to a connection object, and a plurality of terminals having movable springs that support the fitting-side housing displaceably relative to the substrate-side housing. The fitting-side housing is formed by a plurality of divided housings separately provided, and the substrate-side housing includes a receiving chamber that receives the divided housings therein, and an abutment receiving portion against which the divided housings displaced inside the receiving chamber abut. The terminals are disposed in each of the divided housings, and have contact portions to be in conductive contact with the connection object inside the substrate-side housing and the divided housings. The movable springs support each of the divided housings displaceably relative to the substrate-side housing.

A connector according to a second aspect of the present invention includes a first connector to be mounted on a first substrate and a second connector to be mounted on a second substrate. The first connector includes a first housing having a substrate-side housing to be mounted on the first substrate and a fitting-side housing formed by a plurality of divided housings separately provided, and a plurality of first terminals that support the substrate-side housing and the divided housings of the fitting-side housing displaceably and have contact portions to be in conductive contact with a connection object inside the substrate-side housing and the fitting-side housing. The substrate-side housing includes a receiving chamber in which the divided housings are disposed and an abutment receiving portion against which the divided housings displaced inside the receiving chamber abut. The second connector includes a second housing formed by a single molded body having a plurality of fit connecting parts corresponding to the divided housings.

According to these aspects of the present invention, the fitting-side housing is formed by a plurality of divided housings provided separately in a width direction of the connector. Since the fitting-side housing is not long unlike the related art, even when the substrates are tilted relative to each other before fitting to a counterpart connector, the displacement amount of the movable springs of the terminals in each of the divided housings in a fitted state can be kept down. This can reduce the stress constantly acting on the movable springs.

The substrate-side housing includes the receiving chamber in which the divided housings are disposed, and the abutment receiving portion against which the divided housings displaced inside the receiving chamber abut. For this reason, the size of the receiving chamber of the substrate-side housing serves as a spatial limitation, and the displacement amount of the movable springs in each of the divided housings can be kept down even when the connector is fitted to the counterpart connector in a state in which the substrates are tilted relative to each other.

Since the displacement amount of the movable springs can be kept down in the present invention, as described above, even when the connector is fitted and connected to the counterpart connector in the state in which the substrates are tilted relative to each other, the stress constantly acting on the movable springs can be reduced. Hence, it is possible to suppress the occurrence of plastic deformation and deterioration of fatigue durability of the movable springs due to the action of excessive load.

Further, the terminals are disposed in each of the divided housings, and have the contact portions that are in conductive contact with the connection object inside the substrate-side housing and the divided housings. The movable springs support each of the divided housings displaceably relative to the substrate-side housing. For example, in the connector as a comparative example in which the contact portions of terminals are located in the divided housing, but are located outside the substrate-side housing, when the substrates are tilted relative to each other before fitting, the divided housings tilt in the initial state of fitting, and the contact positions of the contact portions move to the positions far from the normal contact positions of the contact portions when the substrates are not tilted. In this state, the divided housings tilt to an extent such as to greatly enter the movable gaps in the width direction and the front-rear direction of the connector.

In the present invention, however, the contact portions of the terminals are located inside the divided housings and the substrate-side housing, and the turn center of the divided housings is closer to the positions of the contact portions than in the comparative example. For this reason, even when the substrates are tilted relative to each other before fitting, the contact positions of the contact portions hardly move from the normal contact positions of the contact portions when the substrates are not tilted. Hence, the movable gaps are not used up in the initial state of fitting. Therefore, when the contact portions are disposed inside the substrate-side housing and the divided housings as in the present invention, it is possible to maintain the floating function using the movable gaps while permitting the tilt of the substrates.

The second connector according to the second aspect of the present invention includes the second housing formed by a single molded body having a plurality of fit connecting parts corresponding to the divided housings. Therefore, the divided housings move for fitting and connection according to the insertion fitting positions and postures of the respective fit connecting parts.

Preferably, the substrate-side housing has an opening opposed to the substrate to allow the divided housings to abut against the substrate.

Since the divided housings abut against the substrate through the opening, the movable springs can be prevented from excessively expanding in the direction in which the divided housings approach the substrate.

Preferably, the receiving chamber of the substrate-side housing has a size such as to receive the divided housings entirely, and the fitting-side housing is disposed inside the substrate-side housing.

Since the divided housings are entirely received in the receiving chamber of the substrate-side housing, the substrate-side housing and the divided housings do not protrude outward. This can reduce the total size of the connector.

Preferably, the substrate-side housing has a movable gap that permits a tilt due to a turn of at least one of the divided housings and the substrate-side housing.

Because of the movable gap, the movable amount of the divided housings can be ensured.

Preferably, the abutment receiving portion is an inward projecting portion provided at a fitting port of the substrate-side housing through which the connection object is inserted.

Since the abutment receiving portion is the inward projecting portion provided in the substrate-side housing, it is unnecessary to provide, in the substrate-side housing, the abutment receiving portion to be engaged with the fall-preventing projection of the fitting-side housing so that the abutment receiving portion projects outward, unlike the related art. This can reduce the total size of the connector in the width direction.

Preferably, the connection object is another connector to be mounted on another substrate conductively connected to the substrate.

According to this, the connector can be carried out as an inter-substrate connecting connector having the above operational advantages.

According to the connector of the present invention, even when the substrates are tilted relative to each other before fitting to the counterpart connector, the displacement amount of the movable springs in the divided housings in the fitted state and the acting stress can be reduced, and the occurrence of plastic deformation and deterioration of fatigue durability are suppressed. Hence, it is possible to realize a connector that improves vibration resistance, achieves size reduction of the entire connector, and has a floating function.

BRIEF DESCRIPTION OF THE DRAWINGS

FIG. 3 is an external perspective view of a housing provided in the plug connector of FIG. 1.

FIGS. 4A and 4B are external perspective views of terminals provided in the plug connector of FIG. 1, FIG. 4A is an external perspective view of a terminal for signal connection, and FIG. 4B is an external perspective view of a terminal for power connection.

DESCRIPTION OF THE PREFERRED EMBODIMENTS

Figure 1:
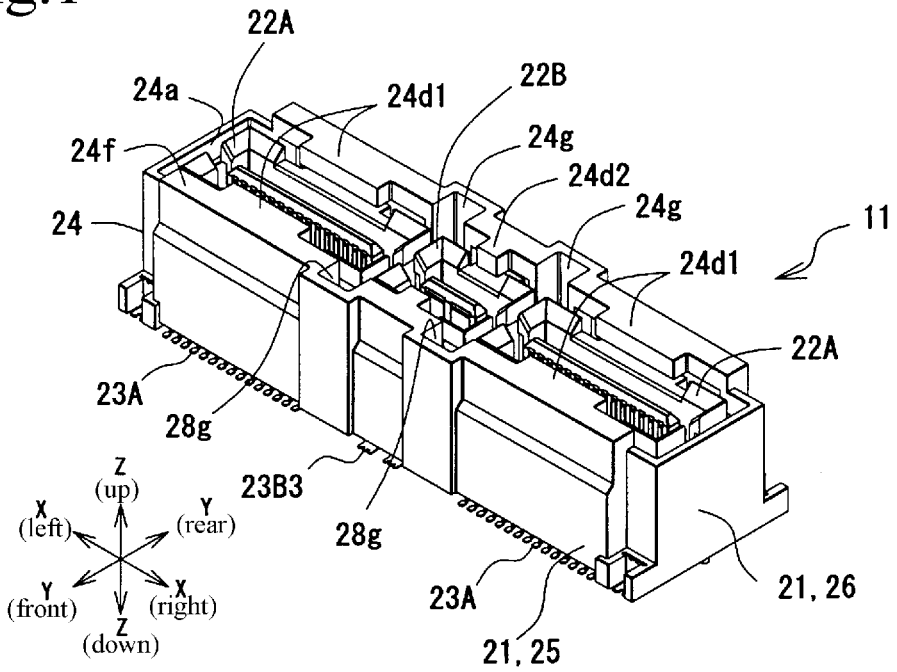
FIG. 1 is an external perspective view of a plug connector (first connector) according to an embodiment.

A connector 10 according to an embodiment of the present invention will be described below with reference to the drawings. In the specification, claims, and drawings of the present application, the long-side direction of the connector 10 is designated as a width direction X, the right side in the drawings is designated as "right", and the left side is designated as "left." Similarly, the short-side direction of the connector 10 is designated as a front-rear direction Y, the front side in the drawings is designated as "front", and the rear side is designated as "rear." The height direction of the connector 10 is designated as an up-down direction Z, the plan side in the drawings is designated as "up", and the bottom side is designated as "down." However, these definitions of right, left, front, rear, up, and down do not limit the mounting direction and usage state of the connector of the present invention.

The connector 10 is composed of a plug connector 11 (FIGS. 1 to 4) serving as a "first connector" to be mounted on a first substrate P1, and a socket connector 12 (FIGS. 5 and 6) serving as a "second connector" to be mounted on a second substrate P2. The plug connector 11 is provided with a movable mechanism.

Plug Connector 11 (FIGS. 1 to 4)

The plug connector 11 includes a substrate-side housing 21, fitting-side housings 22A and 22B serving as "divided housings", and a plurality of terminals 23A and 23B. The substrate-side housing 21 is structured as a "fixed housing" to be mounted on the first substrate P1. The fitting-side housings 22A and 22B are structured as "movable housings" supported by the terminals 23A and 23B to be displaceable relative to the substrate-side housing 21.

Two right and left fitting-side housings 22A hold the terminals 23A for signal connection, and the center fitting-side housing 22B holds the terminals 23B for power connection. The fitting-side housings 22A for signal connection extend long in the width direction X because they need to hold multiple terminals 23A arranged in correspondence with multiple signal connections. While the connector is structured to perform signal connection and power connection in the embodiment, this is just an exemplary embodiment of the present invention. The connector can have other connector structures.

Figure 2:
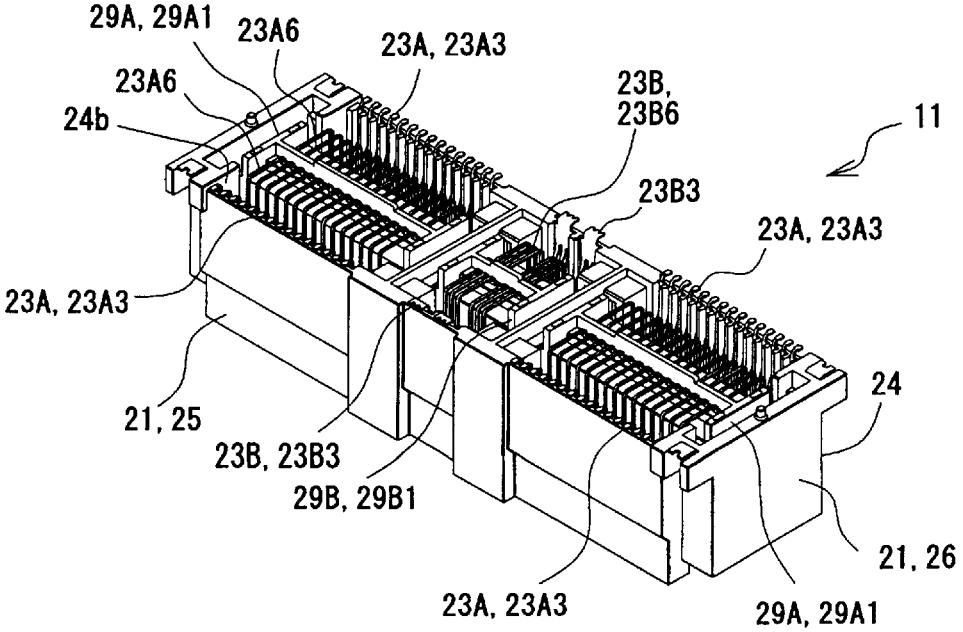
FIG. 2 is a perspective bottom view of the plug connector of FIG. 1.

The substrate-side housing 21 is a molded body formed of an electrically insulating synthetic resin, and has a peripheral wall 24 shaped like a rectangular cylinder. The peripheral wall 24 is a housing for a multiple connector in which multiple terminals 23A and 23B are arranged. The peripheral wall 24 includes a pair of long-side walls 25 along the width direction X and a pair of short-side walls 26 along the front-rear direction Y. In an upper part of the peripheral wall 24, a fitting port 24*a* in which the socket connector 12 is to be inserted is provided. An upper surface 24*f* of the peripheral wall 24 is formed as a flat surface. In a lower part of the peripheral wall 24, an opening 24*b* is provided to open toward the first substrate P1, as illustrated in FIG. 2.

Inside the peripheral wall 24, three receiving chambers 24*c*1 and 24*c*2 are provided (FIG. 3). The right and left receiving chambers 24*c*1 receive the wide fitting-side housings 22A for signal connection, and the center receiving chamber 24*c*2 receives the narrow fitting-side housing 22B for power connection. The inside of the peripheral wall 24 does not include a partition wall for separating the receiving chambers 24*c*1 and 24*c*2, but forms one receiving space. Therefore, the size of the plug connector 11 in the width direction X can be made smaller than in the connector structure in which the fitting-side housings 22A and 22B are received with partition walls being disposed therebetween.

In upper parts of the receiving chambers 24*c*1 and 24*c*2, that is, at the fitting port 24*a*, abutment receiving portions 24*d*1 and 24*d*2 project inward as "projecting portions" from an upper edge of the peripheral wall 24. The abutment receiving portions 24*d*1 and 24*d*2 function as stoppers against which the fitting-side housings 22A and 22B abut when displaced in a removing direction in which the socket connector 12 is removed from the plug connector 11.

As illustrated in FIG. 3, the receiving chambers 24*c*1 and 24*c*2 have terminal holding grooves 24*e*1 and 24*e*2, respectively, which hold the terminals 23A and 23B at one end. Between the right and left receiving chambers 24*c*1 and the center receiving chamber 24*c*2, engaging grooves 24*g* are provided so that columnar projections 37 of the socket connector 12 to be described later are to be inserted therein.

Figure 10:
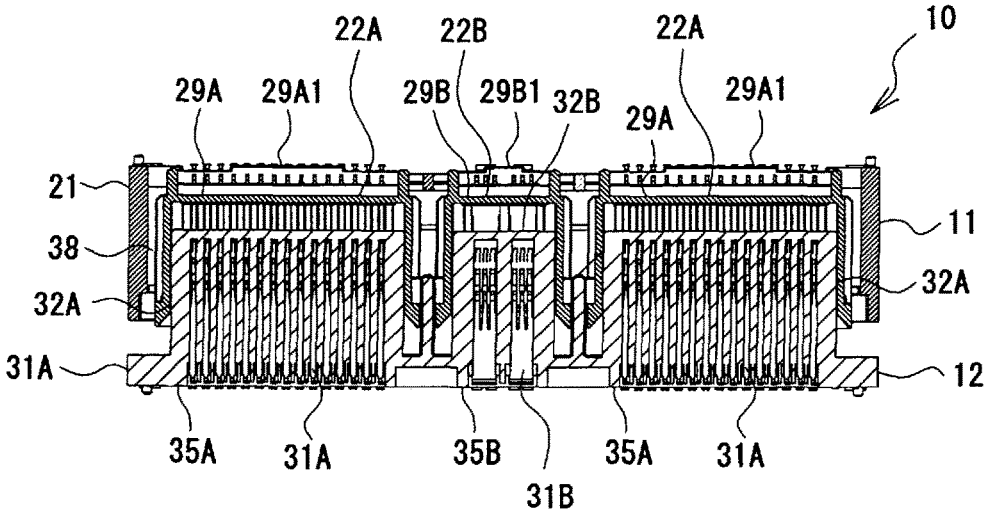
FIG. 10 is a cross-sectional view taken along line X-X of FIG. 9.
Figure 11:
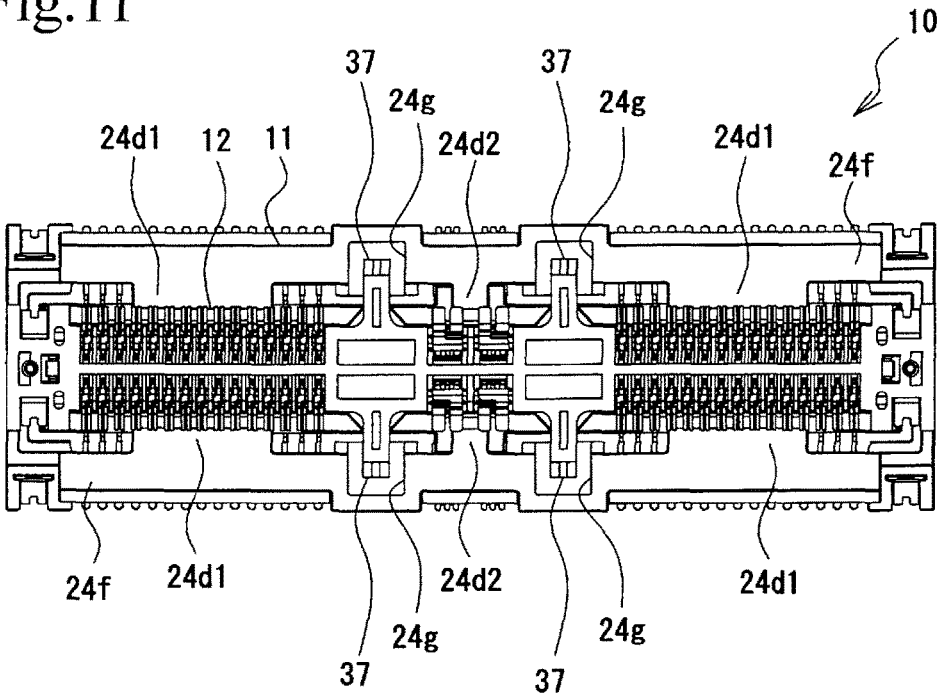
FIG. 11 is a plan view of FIG. 7.

As illustrated in FIG. 3, the two fitting-side housings 22A for signal connection are each composed of a peripheral wall 27A, a center wall 28A, and a bottom wall 29A (FIG. 10).

At an upper end of the peripheral wall 27A, a fitting port 27A1 for the socket connector 12 and abutting portions 27A2 projecting outward in a flange shape from the fitting port 27A1 are provided. The upper end except for the abutting portions 27A2 has a fitting guide surface 27A3 inclined inward, and the fitting guide surface 27A3 guides insertion and fitting of the socket connector 12.

Surfaces of the center wall 28A in the front-rear direction Y have multiple terminal holding grooves 28A1, and the terminal holding grooves 28A1 hold the terminals 23A for signal connection at the other end.

The bottom wall 29A has abutting leg portions 29A1 projecting downward and shaped like an H-shaped thin plate. When the fitting-side housings 22A are displaced toward the first substrate P1, they stop displacement by abutment of the abutting leg portions 29A1 against the first substrate P1.

The fitting-side housing 22B for power connection has a structure substantially similar to that of the fitting-side housings 22A except that the total length thereof is small. Specifically, the fitting-side housing 22B is composed of a peripheral wall 27B, a center wall 28B, and a bottom wall 29B (FIG. 10), and includes a fitting port 27B1, abutting portions 27B2, a fitting guide surface 27B3, terminal holding grooves 28B1, and abutting leg portions 29B1.

Figure 9:
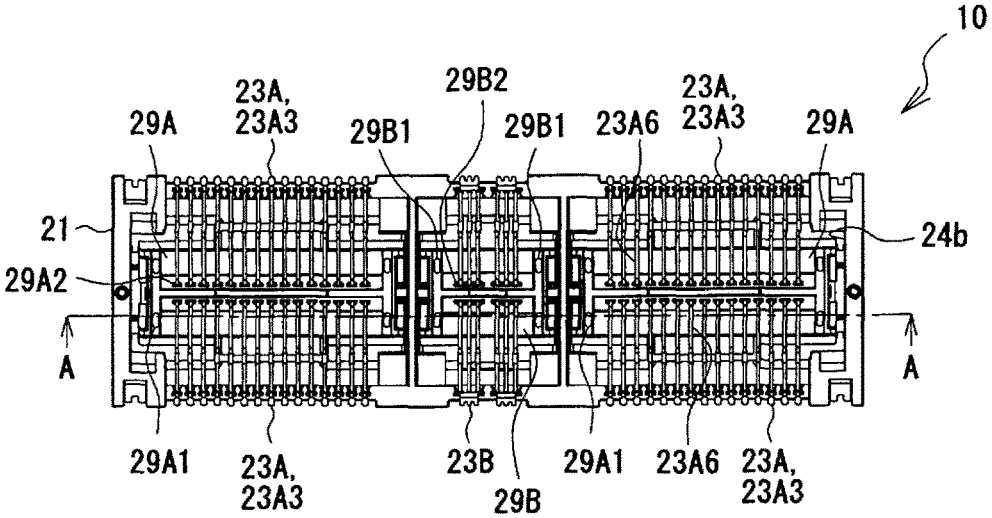
FIG. 9 is a bottom view of FIG. 7.
Figure 12:
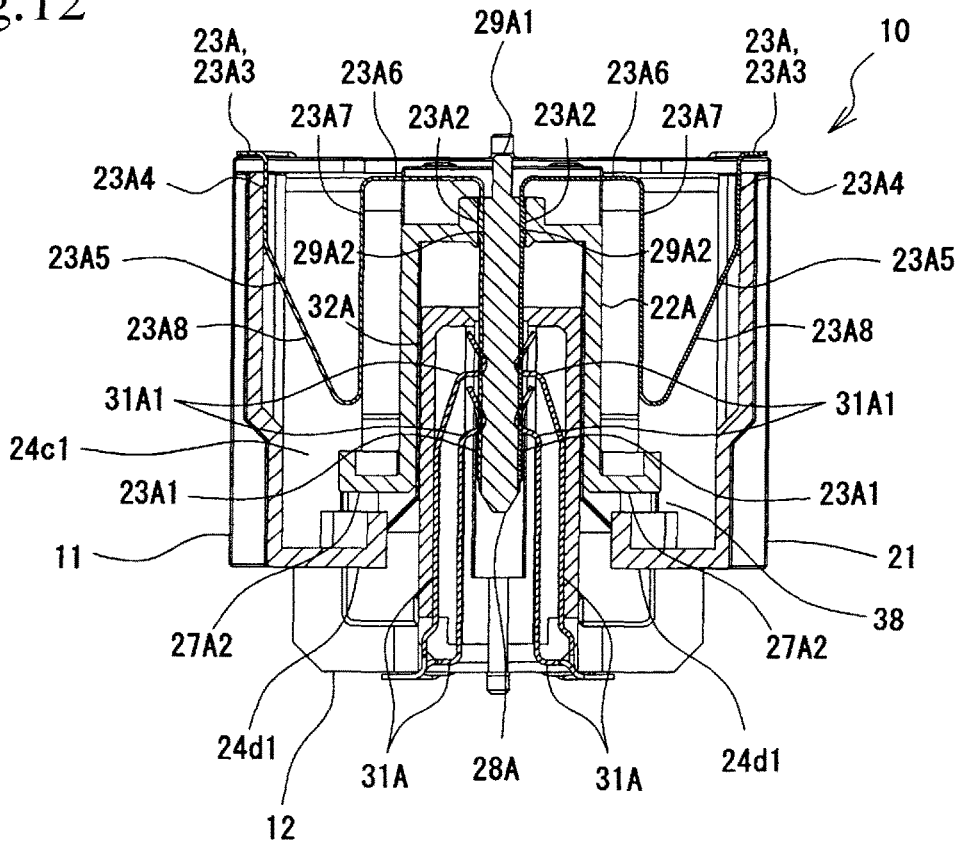
FIG. 12 is a cross-sectional view taken along line XII-XII of FIG. 7.

As illustrated in FIG. 4, the terminals 23A for signal connection have their respective contact portions 23A1 shaped like a flat plate to be held by the terminal holding groove 28A1 in the fitting-side housings 22A. At a lower end of each of the contact portions 23A1, a fixing projection 23A2 is provided. The fixing projection 23A2 is fixedly press-fitted in a press-fitting hole 23A3 penetrating the bottom wall 29A of the corresponding fitting-side housing 22A (FIGS. 9 and 12). At the other end of the terminal 23A, a substrate connecting portion 23A3 and a fixing projection 23A4 press-fitted and held in the corresponding terminal holding groove 24*e*1 in the substrate-side housing 21 are provided. A portion of the terminal 23A between the fixing projection 23A2 and the fixing projection 23A4 serves as a movable spring 23A5. The fitting-side housing 22A is thereby elastically supported in a floating state relative to the substrate-side housing 21 so that it can be displaced in three-dimensional directions. The movable spring 23A5 has a horizontal piece portion 23A6 and a vertical piece portion 23A7. The horizontal piece portion 23A6 and the vertical piece portion 23A7 extend around along an outer bottom surface and an outer side surface of the fitting-side housing 22A to contribute to size reduction of the plug connector 11 having the floating function. The movable spring 23A5 also has an inclined piece portion 23A8, and this allows soft displacement in the oblique direction.

Each terminal 23B for power connection has a structure similar to that of the terminal 23A for signal connection, and includes a contact portion 23B1, a fixing projection 23B2, a substrate connecting portion 23B3, a fixing projection 23B4, a movable spring 23B5, a horizontal piece portion 23B6, a vertical piece portion 23B7, and an inclined piece portion 23B8. However, since the terminal 23B is provided for power connection, the plate width thereof is entirely large. Further, the movable spring 23B5 is composed of three divided spring pieces extending in parallel. Thus, the terminal 23B can be elastically and softly displaced while ensuring a large cross-sectional area at both ends to correspond to a large current application.

Figure 5:
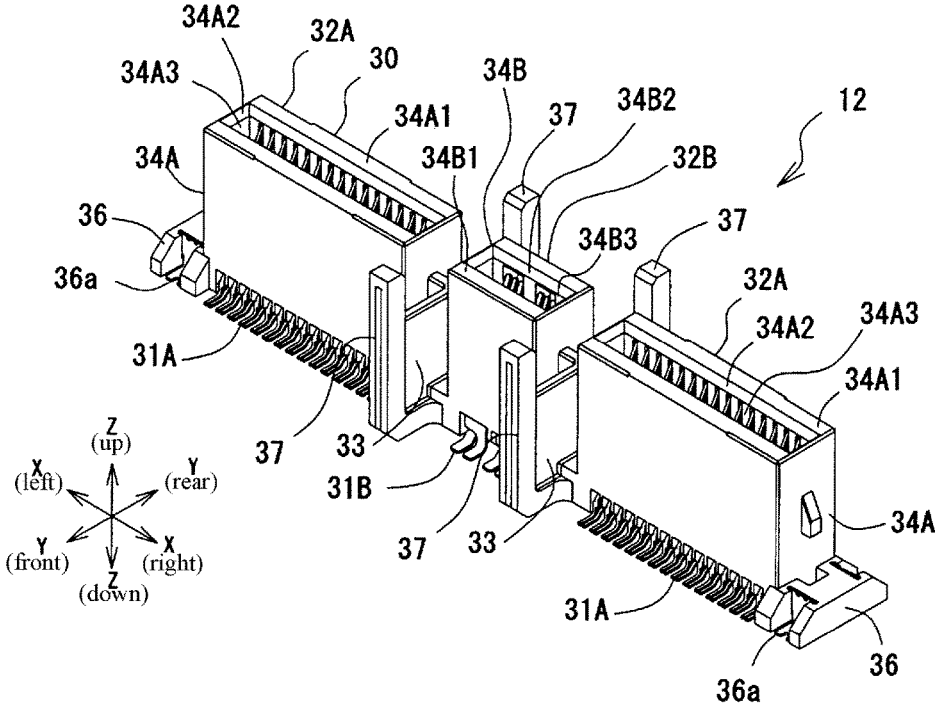
FIG. 5 is an external perspective view of a socket connector (second connector) according to the embodiment.
Figure 6:
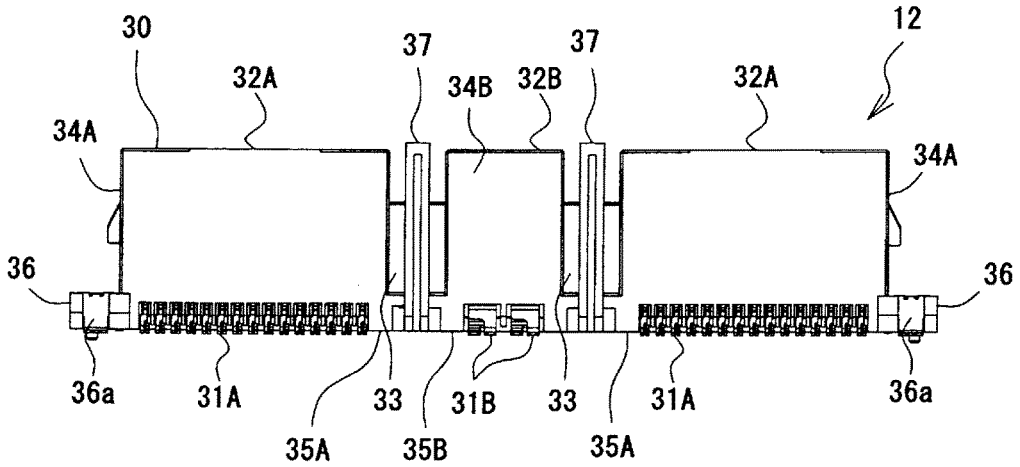
FIG. 6 is a front view of the socket connector of FIG. 5.
Figure 7:
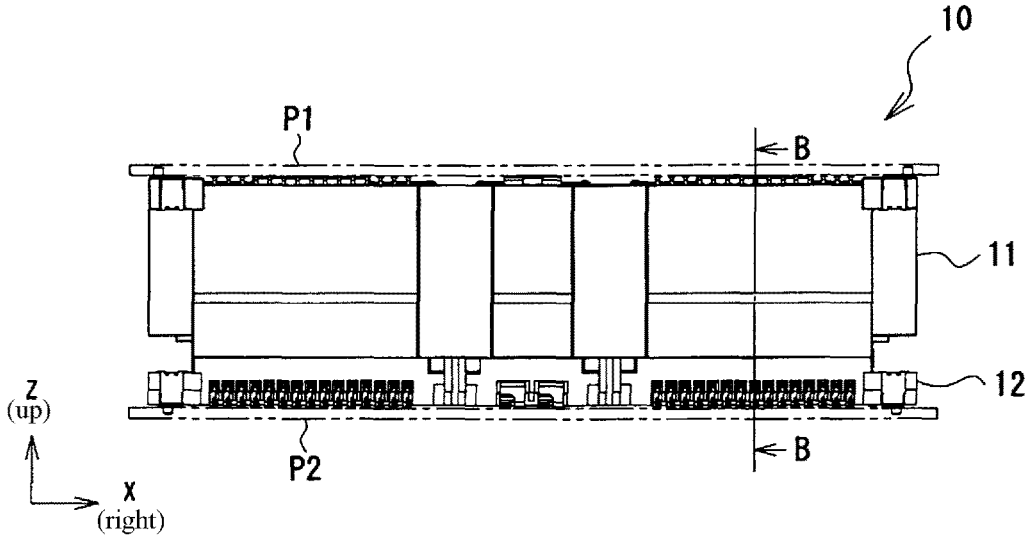
FIG. 7 is a front view illustrating fitting of the plug connector of FIG. 1 and the socket connector of FIG. 5.
Figure 8:
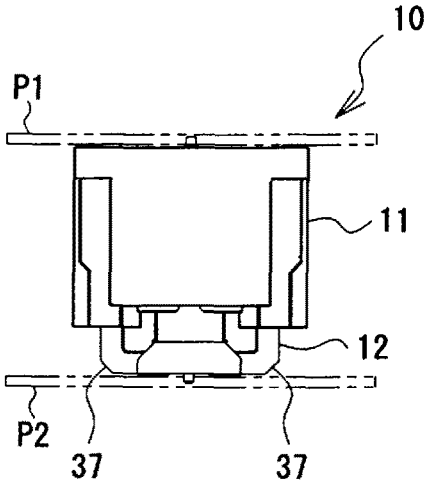
FIG. 8 is a right side view of FIG. 7.

Socket Connector (FIGS. 5 and 6)

The socket connector 12 includes a housing 30 formed by a single molded body of an electrically insulating synthetic resin, terminals 31A for signal connection, and terminals 31B for power connection. The socket connector 12 is mounted on the second substrate P2. The housing 30 includes right and left fit connecting parts 32A shaped like a rectangular cylinder to be connected to the fitting-side housings 22A for signal connection in the plug connector 11, and a center fit connecting part 32B shaped like a rectangular cylinder to be connected to the fitting-side housing 22B for power connection. The right and left fit connecting parts 32A and the center fit connecting part 32B are connected by connecting portions 33 formed by vertical walls intersecting in a cross form.

Each of the right and left fit connecting parts 32A includes a peripheral wall 34A and a bottom wall 35A (FIG. 6), and an upper end surface 34A1 of the peripheral wall 34A is a flat surface. In an upper part of the peripheral wall 34A, a fitting port 34A2 in which the center wall 28A of the plug connector 11 is to be inserted is provided. An inside of the peripheral wall 34A serves as a fitting chamber 34A3 in which the terminals 31A are in conductive contact with the terminals 23A of the plug connector 11. A fixing portion 36 to be fixed to the second substrate P2 with a metal fitting 36*a* being disposed therebetween is provided on an outer side surface of the fit connecting part 32A.

The center fit connecting part 32B has a structure similar to that of the right and left fit connecting parts 32A, and includes a peripheral wall 34B and a bottom wall 35B (FIG. 6). The peripheral wall 34B includes an upper end surface 34B1, a fitting port 34B2, and a fitting chamber 34B3.

At both ends of each of the connecting portions 33 extending in the front-rear direction Y, columnar projections 37 are provided as an "abutting portion." In the embodiment, the columnar projections 37 stand on four corners of the center fit connecting part 32B. That is, the columnar projections 37 are disposed in a center area of the socket connector 12 in the width direction X. Therefore, in misconnection preventing functions 1 to 5 to be described later, even a small tilt and a small displacement of the plug connector 11 and the socket connector 12 can be detected and the insertion posture can be corrected. Upper ends of the columnar projections 37 are provided at positions protruding from the upper end surfaces 34A1 and 34B1 of the fit connecting parts 32A and 32B in the up-down direction Z. Such protrusion of the upper ends of the columnar projections 37 also allows reliable detection of the above-described misconnection due to a small tilt and a small displacement.

Description of Behavior and Operational Advantages of Connector 10

Next, the behavior and operational advantages of the above-described connector 10 according to the embodiment will be described.

1. Fitting and Connection of Plug Connector 11 and Socket Connector 12 (FIGS. 7 to 12)

FIGS. 7 to 12 illustrate a state in which the plug connector 11 and the socket connector 12 are fitted and connected to each other. This achieves inter-substrate connection between the first substrate P1 and the second substrate P2. In the state illustrated in FIGS. 7 to 12, the first substrate P1 and the second substrate P2 do not tilt, are arranged without being misaligned with each other, and are conductively connected by the connector 10. As illustrated in FIG. 12, in the fitted and connected state, the fit connecting parts 32A and 32B of the socket connector 12 are inserted in the fitting-side housings 22A and 22B of the plug connector 11, and the center walls 28A and 28B of the fitting-side housings 22A and 22B are inserted in the fit connecting parts 32A and 32B. Therefore, inside the fit connecting parts 32A and 32B, the contact portions 31A1 and 31B1 shaped like cantilevered spring pieces in the terminals 31A and 31B of the socket connector 12 are in pressure contact with the flat contact portions 23A1 and 23B1 of the terminals 23A and 23B in the plug connector 11 with a predetermined contact force. This makes conductive connection.

Such contact portions 23A1 and 23B1 of the plug connector 11 are located inside the fitting-side housings 22A and 22B and the substrate-side housing 21 in the plug connector 11. For this reason, the turn centers of the fitting-side housings 22A and 22B are closer to the positions of the contact portions 23A1 and 23B1 than in other connectors having a structure in which the contact portions of the terminals are outside the substrate-side housing. Thus, even when the first substrate P1 and the second substrate P2 are tilted before fitting, the contact positions of the contact portions 23A1 and 23B1 hardly move. Therefore, in the tilted state at the beginning of fitting, the fitting-side housings 22A and 22B are not displaced to an extent such as to use up movable gaps 38. Hence, the floating function using the movable gaps 38 can be maintained while permitting the tilt of the first substrate P1 and the second substrate P2.

2. Floating Function of Fitting-Side Housings 22A and 22B in Plug Connector 11 (FIGS. 13 and 14)

A description will be given of an operation of conductively connecting the first substrate P1 and the second substrate P2 tilted relative to each other by the plug connector 11 and the socket connector 12. Since the first substrate P1 is tilted relative to the second substrate P2, the fitting-side housings 22A and 22B can be displaced in three-dimensional directions inside the receiving chambers 24*c*1 and 24*c*2 of the substrate-side housing 21 in the plug connector 11 by elastic deformation of the movable springs 23A5 and 23B5 of the terminals 23A and 23B. The movable gaps 38 are provided between the inner surfaces of the receiving chambers 24*c*1 and 24*c*2 and the fitting-side housings 22A and 22B (FIGS. 10 and 12), and the fitting-side housings 22A and 22B are displaced within the movable gaps 38. Thus, the relative tilt between the first substrate P1 and the second substrate P2 can be absorbed by the connector 10.

Figure 13:
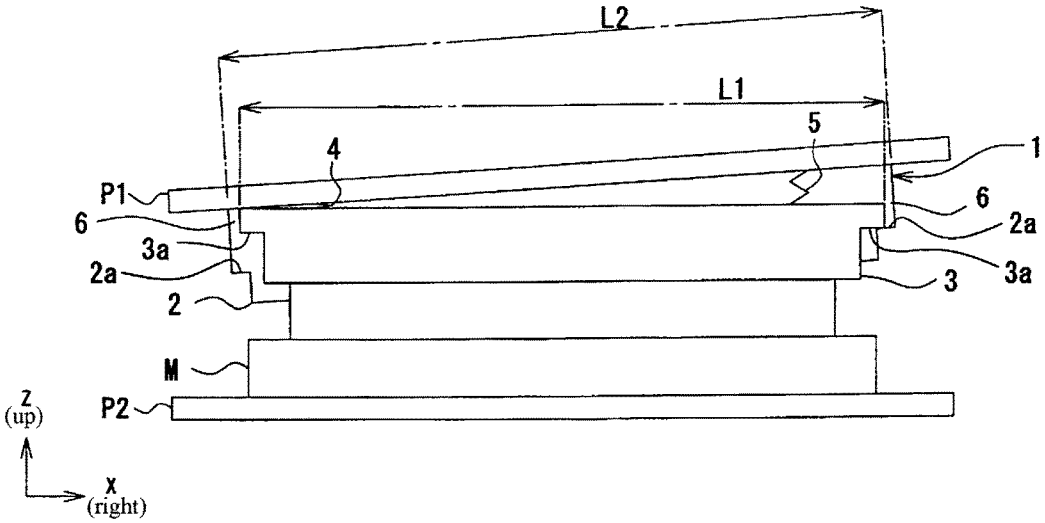
Fig.13 Prior Art
FIG. 13 is an explanatory view schematically illustrating the behavior of a conventional connector.

FIG. 13 is an operation explanatory view schematically illustrating the floating operation of the conventional floating connector 1. The first substrate P1 and the second substrate P2 are tilted before the floating connector 1 is fitted and connected to the counterpart connector M. When the fitting-side housing 3 is inserted and fitted to the counterpart connector M in such a state in which the substrates P1 and P2 are tilted relative to each other, the tilt of the first substrate P1 can be absorbed by the movable springs 4 and 5. However, since the fitting-side housing 3 is not a "divided housing", but has a single structure, the right movable spring 5 in FIG. 13 is greatly expanded upward, and a great stress constantly acts in the initial state of the fitting. Hence, in the conventional floating connector 1, problems, such as plastic deformation and deterioration of fatigue durability of the movable springs 4 and 5, sometimes occur.

Figure 14:
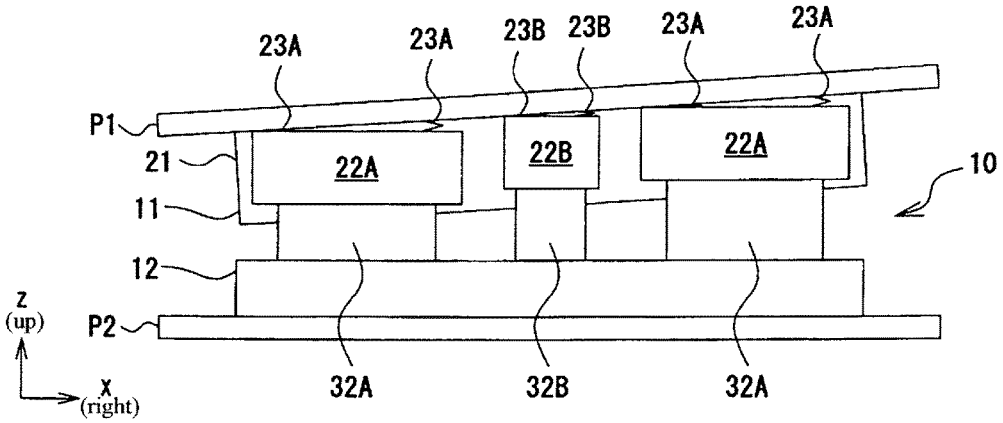
FIG. 14 is an explanatory view schematically illustrating the behavior of a connector according to the embodiment.

In contrast, in the connector 10 of the embodiment, as illustrated in FIG. 14, even when the first substrate P1 is tilted at the same angle as that of FIG. 13 before fitting and connection and the plug connector 11 is fitted and connected to the socket connector 12 in that state, the displacement length of the terminals 23A and 23B in the fitting-side housings 22A and 22B can be kept down because the fitting-side housings 22A and 22B are divided housings. Further, the fitting-side housings 22A and 22B are displaced inside the receiving chambers 24*c*1 and 24*c*2 of the substrate-side housing 21, and the abutting portions 27A2 and 27B2 of the fitting-side housings 22A and 22B abut against the abutment receiving portions 24*d*1 and 24*d*2 of the substrate-side housing 21 in the removing direction. This can change the fitting length of the fit connecting parts 32A and 32B of the socket connector 12 in each of the fitting-side housings 22A and 22B. Even when the first substrate P1 and the second substrate P2 are thus arranged in a tilted state, the displacement amount of the movable springs 23A5 and 23B5 can be kept down in the fitted and connected state of the plug connector 11 and the socket connector 12. Hence, the problems, such as plastic deformation and deterioration of fatigue durability, do not occur.

3. Size Reduction of Connector 10 (FIGS. 13 and 14)

In the conventional floating connector 1, as illustrated in FIG. 13, the fall-preventing projections 3*a* projecting outward are provided in the substrate-side end portions of the fitting-side housing 3, and the abutment receiving portions 2*a* with which the fall-preventing projections 3*a* engage are provided in the substrate-side housing 2. For this reason, the conventional floating connector 1 has a problem in that a length L1 of the fitting-side housing 3 and a length L2 of the substrate-side housing 2 are large in the width direction X.

When the substrates P1 and P2 are tilted relative to each other, since the fitting-side housing 3 is long in the width direction X, the movable gaps 6 need to be set large to permit displacement. This also increases the total size of the floating connector 1.

Further, according to the fall-preventing projections 3*a* and the abutment receiving portions 2*a* of the conventional floating connector 1, when the single floating connector 1 is provided with a plurality of fitting-side housings, it is necessary to provide the fall-preventing projections 3*a*, the abutment receiving portions 2*a*, and the movable gaps 6 in each of the fitting-side housings. This further increases the size in the width direction X.

In contrast, in the plug connector 11 of the embodiment, when the fitting-side housings 22A and 22B are displaced in the removing direction, the abutting portions 27A2 and 27B2 abut in the removing direction against the abutment receiving portions 24*d*1 and 24*d*2 projecting inward toward the fitting port 24*a* of the substrate-side housing 21, and are disabled from falling off the substrate-side housing 21. That is, even when the housing is a divided housing having a plurality of fitting-side housings 22A and 22B, the fall-preventing projections 3*a* projecting outward, the abutment receiving portions 2*a*, and the movable gap 6 in the conventional floating connector 1 are unnecessary for each of the fitting-side housings 22A and 22B. Hence, the total size of the connector 10 in the width direction X can be reduced.

Further, the fitting-side housings 22A and 22B are divided housings, and even when the first substrate P1 and the second substrate P2 are tilted, the displacement amount relative to the first substrate P1 in the fitted state to the socket connector 12 can be reduced. Therefore, it is possible to set the movable gaps 36 to be smaller than in the conventional floating connector 1.

4. Misconnection Preventing Function 1: Function of Preventing Misaligned Fitting in Width Direction X (FIGS. 15 and 16)

Figure 15:
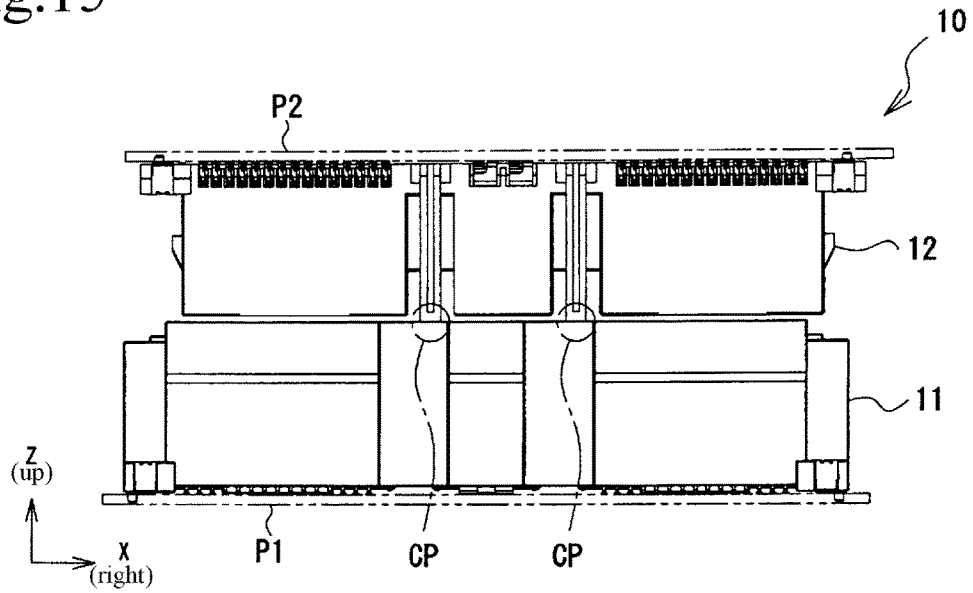
FIG. 15 is a front view illustrating a misaligned state of the connector in the width direction at the time of insertion and fitting.

The connector 10 has a misconnection preventing function of preventing forcible insertion and fitting in a case in which the first substrate P1 and the second substrate P2 are misaligned in the width direction X beyond the movable limit of the movable springs 23A5 and 23B5 when the plug connector 11 and the socket connector 12 are inserted and fitted (FIG. 15).

Figure 16:
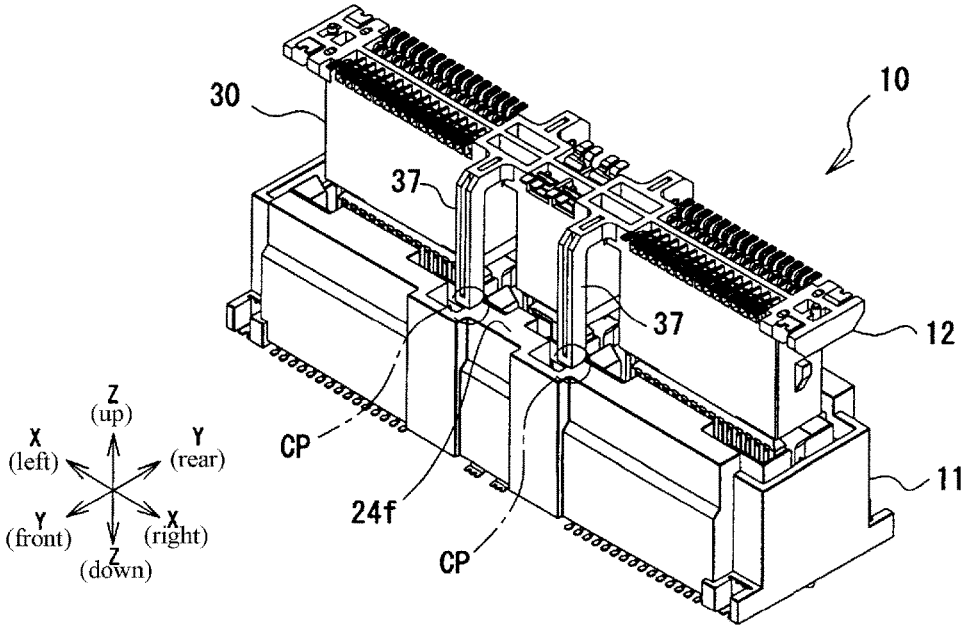
FIG. 16 is a perspective view of FIG. 15.

That is, as illustrated in FIGS. 15 and 16, when misalignment that exceeds the movable limit of the movable springs 23A5 and 23B5 for elastically supporting the fitting-side housings 22A and 22B of the plug connector 11 in a floating state occurs, the columnar projections 37 that form the "abutting portion" of the socket connector 12 abut against the upper surface 24*f* that forms "abutting portion" of the peripheral wall 24 of the substrate-side housing 21, but cannot be inserted in the engaging grooves 24*g*. Since such contact portions CP for restricting misconnection are formed, it is possible to reliably prevent misconnection caused by forcibly inserting and fitting the socket connector 12 into the plug connector 11. This can protect the movable springs 23A5 and 23B5 of the terminals 23A and 23B.

5. Misconnection Preventing Function 2: Function of Preventing Tilted Fitting Using Width Direction X as Turn Axis (FIGS. 17 and 18)

Figure 17:
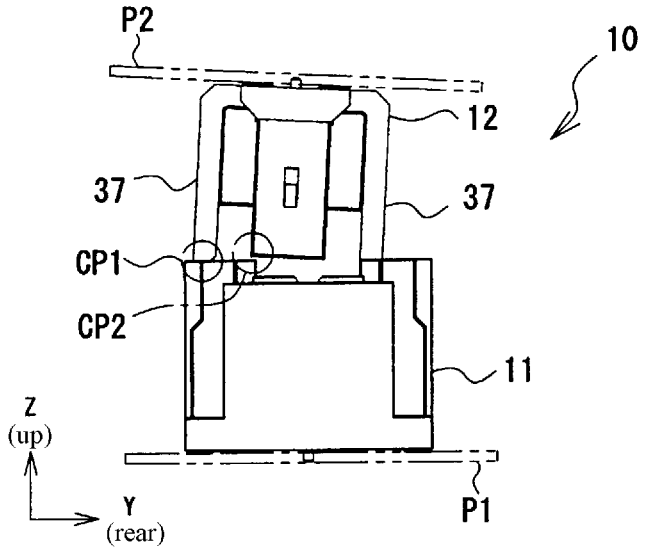
FIG. 17 is a right side view illustrating a state in which the connector tilts using the width direction as a turn axis at the time of insertion and fitting.

The connector 10 has a misconnection preventing function of preventing forcible insertion and fitting in a case in which a tilt is caused by the turn of the first substrate P1 and the second substrate P2 using the width direction X as the turn axis beyond the movable limit of the movable springs 23A5 and 23B5 when the plug connector 11 and the socket connector 12 are inserted and fitted (FIG. 17).

Figure 18:
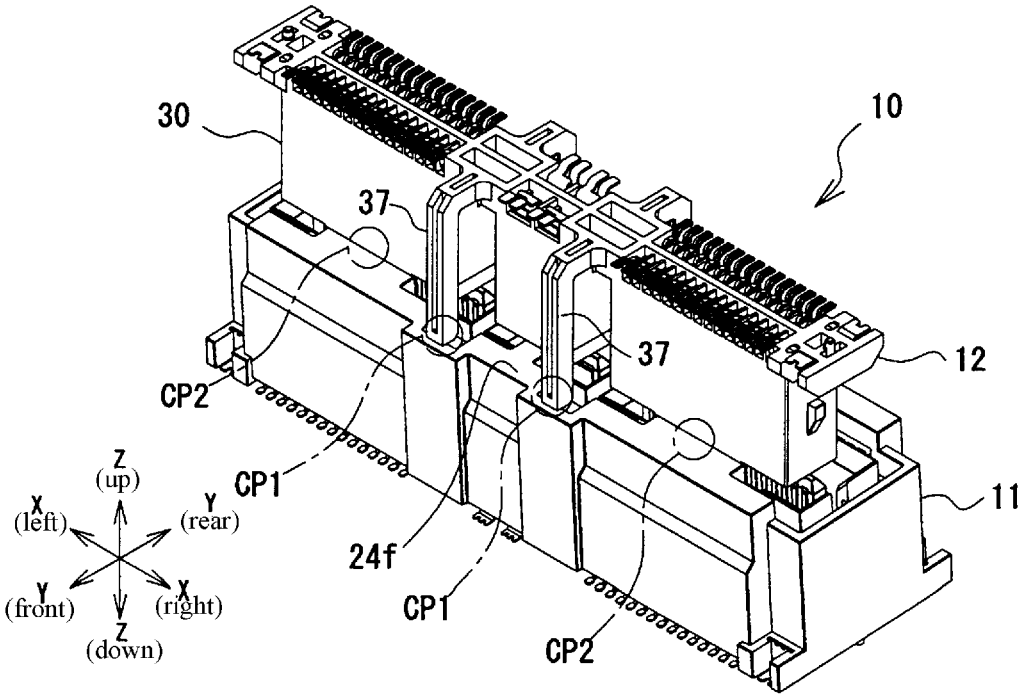
FIG. 18 is a perspective view of FIG. 17.

As illustrated in FIGS. 17 and 18, when the socket connector 12 tilts beyond the movable limit of the movable springs 23A5 and movable spring 23B5 for elastically supporting the fitting-side housings 22A and 22B of the plug connector 11 in the floating state, two columnar projections 37 on the front side, which form "abutting portion" of the socket connector 12, abut against the upper surface 24*f* of the substrate-side housing 21 that forms "abutting portion" of the plug connector 11, but cannot be inserted in the engaging grooves 24*g*. When the socket connector 12 is further tilted by the abutting force, the upper end surface 34A1 that forms "abutting portion" of the housing 30 in the socket connector 12 abuts against the abutment receiving portions 24*d*1 and 24*d*2 of the substrate-side housing 21, and contact portions CP1 and CP2 for restricting misconnection are formed. This can reliably prevent misconnection such that the socket connector 12 is forcibly inserted, and can protect the movable springs 23A5 and 23B5 of the terminals 23A and 23B.

6. Misconnection Preventing Function 3: Function of Preventing Misaligned Fitting in Front-Rear Direction Y (FIGS. 19 and 20)

Figure 19:
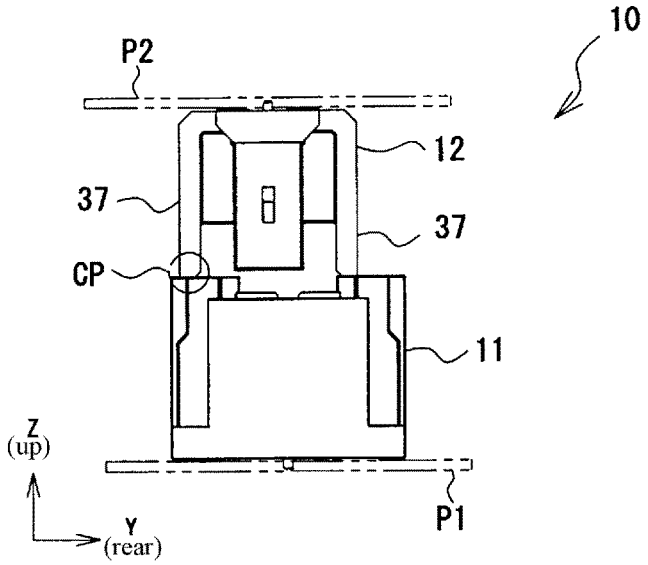
FIG. 19 is a front view illustrating a misaligned state of the connector in the front-rear direction at the time of insertion and fitting.

The connector 10 has a misconnection preventing function of preventing forcible insertion and fitting in a case in which the first substrate P1 and the second substrate P2 are misaligned in the front-rear direction Y beyond the movable limit of the movable springs 23A5 and 23B5 when the plug connector 11 and the socket connector 12 are inserted and fitted (FIG. 19).

Figure 20:
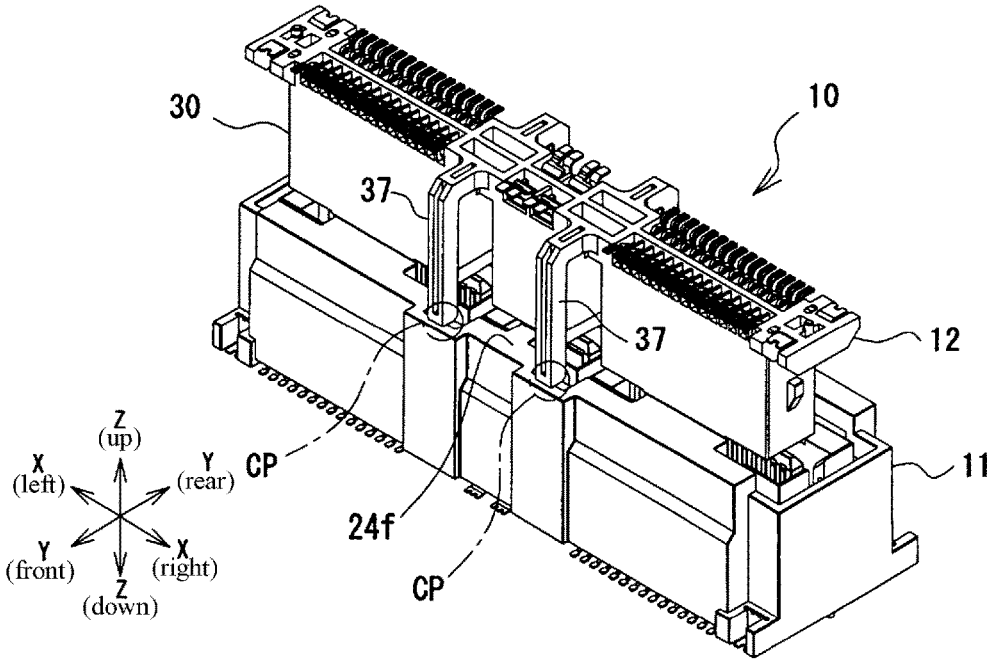
FIG. 20 is a perspective view of FIG. 19.

As illustrated in FIGS. 19 and 20, when the socket connector 12 is misaligned in the front-rear direction Y beyond the movable limit of the movable springs 23A5 and 23B5 for elastically supporting the fitting-side housings 22A and 22B of the plug connector 11 in the floating state, the two columnar projections 37 on the front side, which form "abutting portion" of the socket connector 12, abut against the upper surface 24*f* of the substrate-side housing 21 in the plug connector 11, but cannot be inserted in the engaging grooves 24*g*. Further, the upper end surface 34A1 that forms "abutting portion" of the housing 30 in the socket connector 12 abuts against the abutment receiving portions 24*d*1 and 24*d*2 of the substrate-side housing 21, and contact portions CP for restricting misconnection are formed. This can reliably prevent misconnection such that the socket connector 12 is forcibly inserted and can protect the movable springs 23A5 and 23B5 of the terminals 23A and 23B.

7. Misconnection Preventing Function 4: Function of Preventing Tilted Fitting Using Front-Rear Direction Y as Turn Axis (FIGS. 21 to 24)

The connector 10 has a misconnection preventing function of preventing insertion and fitting in a case in which a tilt is caused by the turn of the first substrate P1 and the second substrate P2 using the front-rear direction Y as the turn axis beyond the movable limit of the movable springs 23A5 and 23B5 when the plug connector 11 and the socket connector 12 are inserted and fitted.

Figure 21:
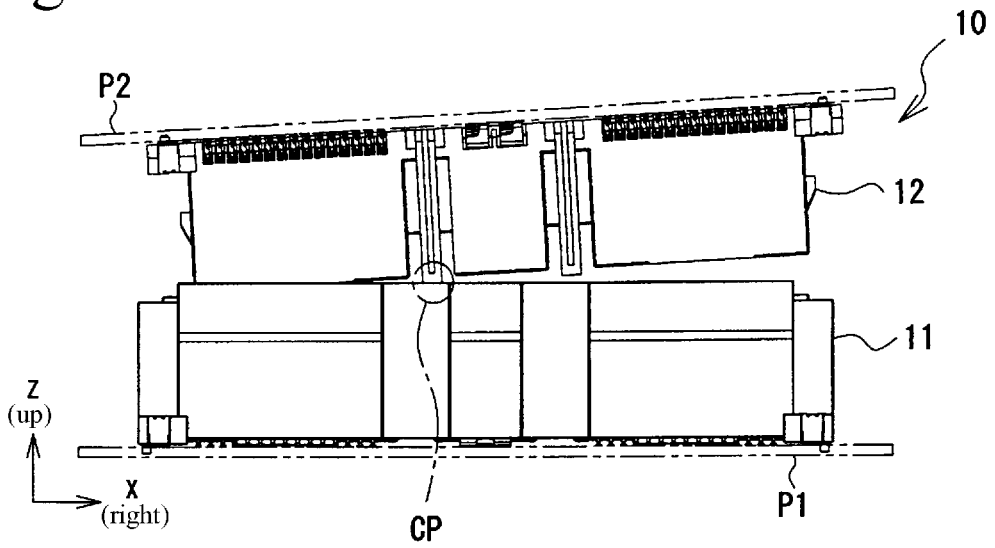
FIG. 21 is a front view illustrating a first tilting state in which the connector tilts by using the front-rear direction as a turn axis at the time of insertion and fitting.
Figure 22:
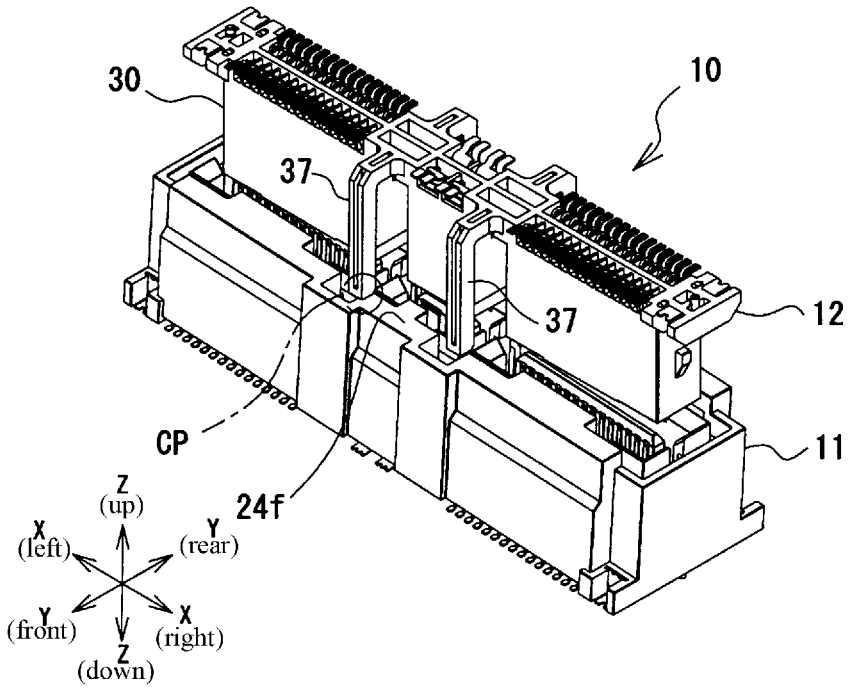
FIG. 22 is a perspective view of FIG. 21.

As illustrated in FIGS. 21 and 22, when the socket connector 12 is tilted beyond the movable limit of the movable springs 23A5 and 23B5 for elastically supporting the fitting-side housings 22A and 22B of the plug connector 11 in the floating state, the two columnar projections 37 on the front side, which form "abutting portion" of the socket connector 12, abut against the upper surface 24*f* that forms "abutting portion" of the substrate-side housing 21 in the plug connector 11, but cannot be inserted in the engaging grooves 24*g*. Since a contact portion CP for restricting such misconnection is formed, it is possible to reliably prevent misconnection such that the socket connector 12 is forcibly inserted and to protect the movable springs 23A5 and 23B5 of the terminals 23A and 23B.

Figure 23:
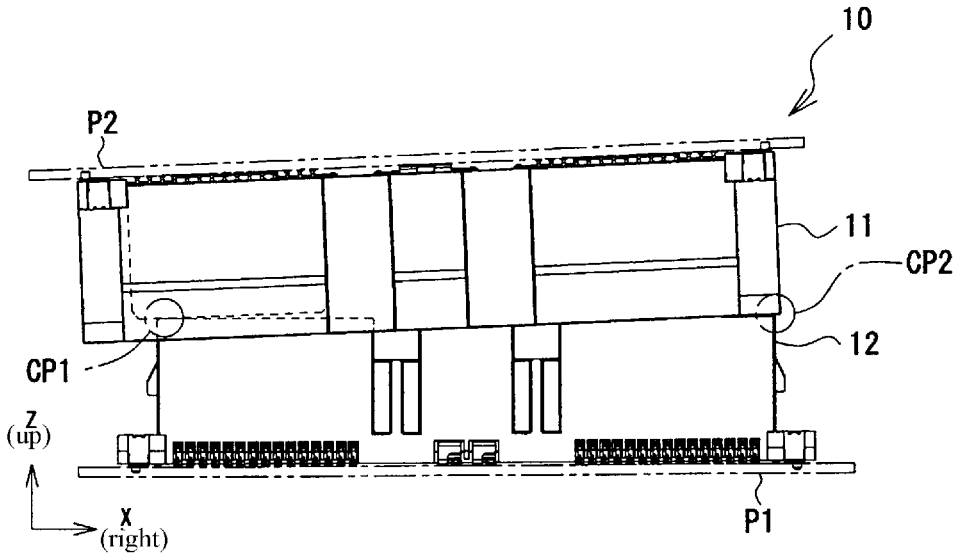
FIG. 23 is a front view illustrating a second tilting state in which the connector tilts by using the front-rear direction as the turn axis at the time of insertion and fitting.
Figure 24:
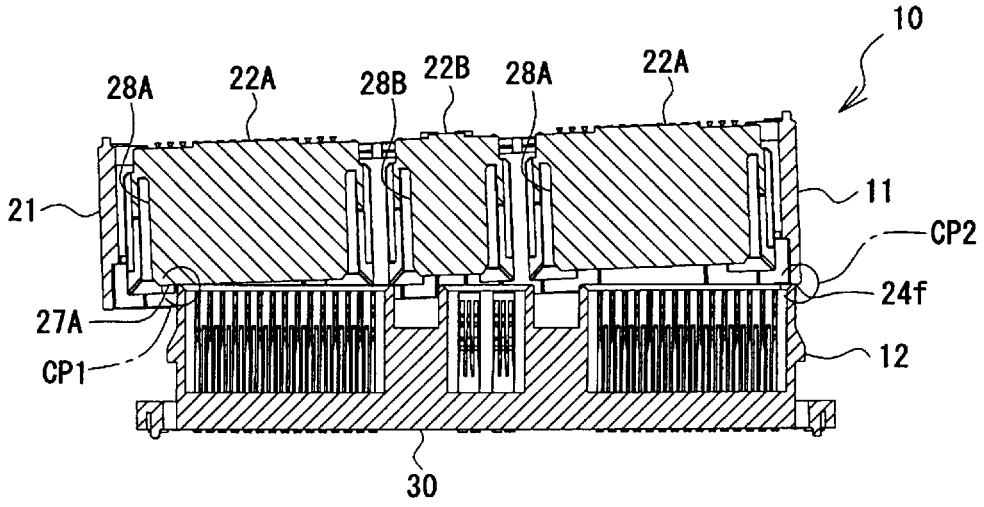
FIG. 24 is a cross-sectional view of FIG. 23.

As illustrated in FIGS. 23 and 24, when the socket connector 12 is further tilted and misaligned, the housing 30 comes into contact with the upper end surface of the peripheral wall 27A that forms "abutting portion" of the fitting-side housing 22A in the plug connector 11 to form a contact portion CP1 for restricting misconnection, and comes into contact with the upper surface 24*f* that forms "abutting portion" of the substrate-side housing 21 to form a contact portion CP2 for restricting misconnection. Therefore, in such a case, it is also possible to reliably prevent misconnection such that the socket connector 12 is forcibly inserted and to protect the movable springs 23A5 and 23B5 of the terminals 23A and 23B.

8. Misconnection Preventing Function 5: Function of Preventing Misaligned Fitting Using Up-Down Direction as Turn Axis (FIGS. 25 and 26)

Figure 25:
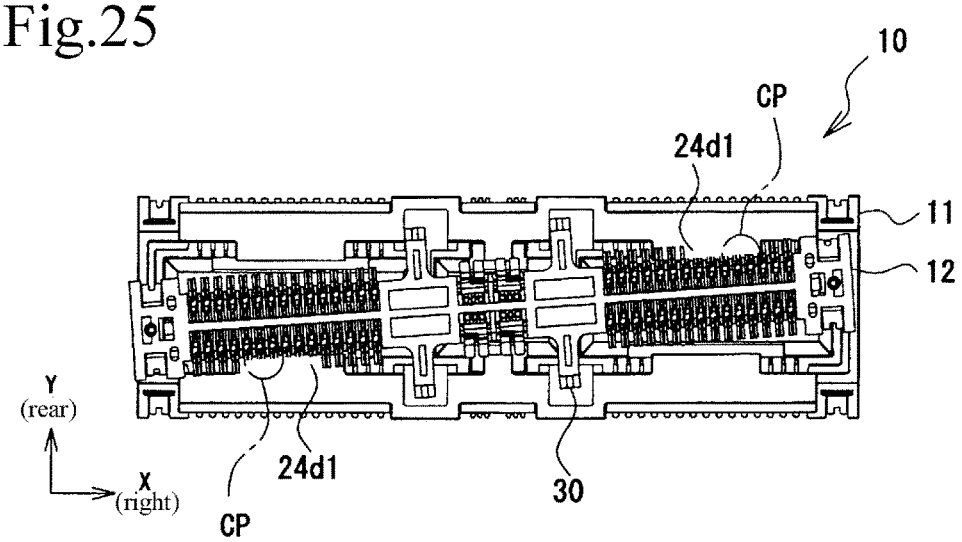
FIG. 25 is a plan view illustrating a misaligned state of the connector using the up-down direction as the turn axis at the time of insertion and fitting.

The connector 10 has a misconnection preventing function of preventing forcible insertion and fitting in a case in which misalignment is caused by the turn of the first substrate P1 and the second substrate P2 using the up-down direction Z as the turn axis beyond the movable limit of the movable springs 23A5 and 23B5 when the plug connector 11 and the socket connector 12 are inserted and fitted (FIG. 25).

Figure 26:
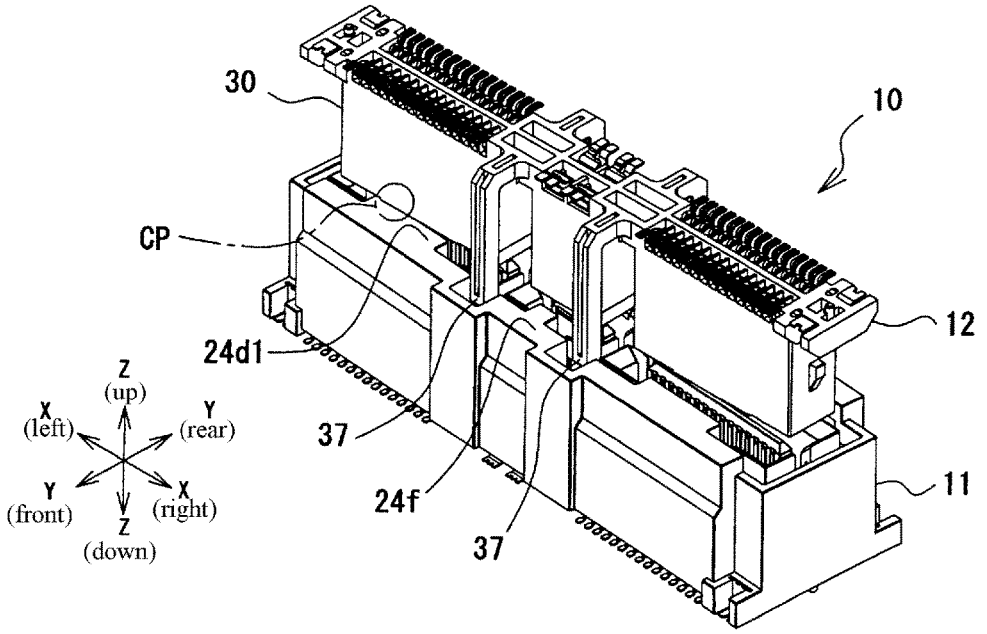
FIG. 26 is a perspective view of FIG. 25.

As illustrated in FIGS. 25 and 26, when the socket connector 12 is misaligned in the front-rear direction Y beyond the movable limit of the movable springs 23A5 and 23B5 for elastically supporting the fitting-side housings 22A and 22B of the plug connector 11 in the floating state, even if the columnar projections 37 can be inserted in the engaging grooves 24*g*, the upper end surface 34A1 that forms "abutting portion" of the housing 30 in the socket connector 12 abuts against the abutment receiving portions 24*d*1 of the substrate-side housing 21 in the plug connector 11 located on the diagonal line, and contact portions CP for restricting misconnection are formed. Thus, it is possible to reliably prevent misconnection such that the socket connector 12 is forcibly inserted and to protect the terminals 23A and 23B.

MODIFICATIONS OF EMBODIMENT

The above-described connector 10 according to the embodiment is just an example, and can be carried out by making modifications within the gist of the present invention.

For example, while the two fitting-side housings 22A for signal connection are provided in the embodiment, one fitting-side housing or three or more fitting-side housings may be provided. Further, while the fitting-side housing 22B for power connection is provided in the embodiment, it may be omitted or two or more fitting-side housings for power connection may be provided. In any case, it is only necessary that a plurality of fitting-side housings should be provided regardless of the use and the number of terminals.

While four columnar projections 37 are provided as "abutting portion" in the embodiment, it is only necessary that at least one columnar projection 37 should be provided. Further, while the columnar projections 37 are provided in the center area of the socket connector 12 in the width direction X, they may be provided in other portions.

What is claimed is:

1. A floating connector with multiple fitting-side housings comprising:

a housing having a substrate-side housing to be mounted on a substrate and a fitting-side housing to be fitted to a connection object; and a plurality of terminals having movable springs that support the fitting-side housing displaceably relative to the substrate-side housing, the terminals fixed at one end to the substrate-side housing and at the other end to the fitting-side housing, wherein the fitting-side housing is formed by a plurality of divided housings moveable separately in a width direction of the connector, wherein the substrate-side housing includes a receiving chamber that receives the divided housings therein and an abutment receiving portion against which the divided housings displaced inside the receiving chamber abut, the abutment receiving portion functions as a stopper against which the fitting-side housing abuts when displaced in a removing direction, wherein the terminals are disposed in each of the divided housings, and have contact portions inside the substrate-side housing and the divided housings, and the contact portions are to be in conductive contact with the connection object, and wherein the movable springs support each of the divided housings displaceably relative to the substrate-side housing.

2. The connector according to claim 1, wherein the substrate-side housing has an opening opposed to the substrate to allow the divided housings to abut against the substrate.

3. The connector according to claim 1, wherein the receiving chamber of the substrate-side housing has a size so as to receive the divided housings entirely.

4. The connector according to claim 1, wherein the substrate-side housing has a movable gap that permits a tilt due to a turn of at least one of the divided housings and the substrate-side housing, the movable gap is provided between an inner surface of the receiving chamber and the fitting-side housing.

5. The connector according to claim 1, wherein the abutment receiving portion is an inward projecting portion provided at a fitting port of the substrate-side housing through which the connection object is to be inserted.

6. The connector according to claim 1, wherein the connection object is another connector to be mounted on another substrate to be conductively connected to the substrate.

7. A floating connector with multiple fitting-side housings comprising:

a first connector to be mounted on a first substrate; and a second connector to be mounted on a second substrate, wherein the first connector includes a first housing having a substrate-side housing to be mounted on the first substrate and a fitting-side housing formed by a plurality of divided housings moveable separately in a width direction of the connector, and a plurality of first terminals that support the substrate-side housing and the divided housings of the fitting-side housing displaceably and have contact portions inside the substrate-side housing and the divided housings, and the contact portions are to be in conductive contact with the second connector, the terminals fixed at one end to the substrate-side housing and at the other end to the fitting-side housing, wherein the substrate-side housing includes a receiving chamber in which the divided housings are disposed and an abutment receiving portion against which the divided housings displaced inside the receiving chamber abut, the abutment receiving portion functions as a stopper against which the fitting-side housing abuts when displaced in a removing direction, and wherein the second connector includes a second housing formed by a single molded body having a plurality of fit connecting parts corresponding to the divided housings.

8. The connector according to claim 7, wherein the substrate-side housing has an opening opposed to the substrate to allow the divided housings to abut against the substrate.

9. The connector according to claim 7, wherein the fitting-side housing is disposed inside the substrate-side housing.

* * * * *